US008204427B2

(12) United States Patent
Yamamoto et al.

(10) Patent No.: US 8,204,427 B2
(45) Date of Patent: Jun. 19, 2012

(54) IMAGE FORMING APPARATUS WITH MULTIPLE LATERAL ALIGNMENT POSITIONS

(75) Inventors: Satoru Yamamoto, Abiko (JP); Ichiro Sasaki, Toride (JP); Naohisa Nagata, Moriya (JP); Akinobu Nishikata, Abiko (JP); Hiroshi Matsumoto, Toride (JP)

(73) Assignee: Canon Kabushiki Kaisha (JP)

( * ) Notice: Subject to any disclaimer, the term of this patent is extended or adjusted under 35 U.S.C. 154(b) by 683 days.

(21) Appl. No.: 12/100,327

(22) Filed: Apr. 9, 2008

(65) Prior Publication Data

US 2008/0253785 A1 Oct. 16, 2008

(30) Foreign Application Priority Data

Apr. 10, 2007 (JP) ..... 2007-102925

(51) Int. Cl.
*G03G 15/00* (2006.01)

(52) U.S. Cl. ..... 399/388; 399/394; 399/395; 399/38

(58) Field of Classification Search ..... 399/394, 399/395, 66, 388; 271/4.11, 10.14, 13, 14, 271/15, 18, 42, 226, 228
See application file for complete search history.

(56) References Cited

U.S. PATENT DOCUMENTS 6,052,552 A * 4/2000 Ohsumi et al. ..... 399/394
6,356,735 B1 * 3/2002 Hozumi ..... 399/395
6,741,831 B2 * 5/2004 Seto ..... 399/388
7,412,177 B2 * 8/2008 Kaneko et al. ..... 399/45
2003/0113149 A1 * 6/2003 Jewell ..... 399/394
2005/0265761 A1 * 12/2005 Kawaai et al. ..... 399/394
2006/0170149 A1 * 8/2006 Seto ..... 271/240

FOREIGN PATENT DOCUMENTS

JP 8-188300 A 7/1996
JP 10-293512 A 11/1998

* cited by examiner

*Primary Examiner* — Judy Nguyen
*Assistant Examiner* — Justin Olamit
(74) *Attorney, Agent, or Firm* — Rossi, Kimms & McDowell LLP

(57) ABSTRACT

An image forming apparatus capable of reducing damage in a fixing section and printing a high-quality image on a sheet at low cost without reducing productivity. A sheet shifting mechanism is arranged upstream of a transfer roller and moves the sheet in a sheet lateral direction orthogonal to the sheet conveying direction. In order to change a position at which a sheet passes through a fixing roller, the sheet shifting mechanism is controlled for every conveyance of a predetermined number of sheets, whereby sheet movement in the sheet lateral direction is controlled. A correction amount for an error due to sheet shifting by the sheet shifting mechanism is stored for each of sheet shift positions. An image forming position in the sheet lateral direction of a photosensitive drum is shifted on the basis of the sheet shift position and the stored correction amount.

5 Claims, 9 Drawing Sheets

| | ROLLER SHIFT AMOUNT (mm) | IMAGE FORMING POSITION CORRECTION AMOUNT (mm) |
|---|---|---|
| R1 | 9.5 | -0.1 |
| R2 | 10.0 | -0.2 |
| R3 | 10.5 | -0.3 |

IMAGE FORMING APPARATUS WITH MULTIPLE LATERAL ALIGNMENT POSITIONS

BACKGROUND OF THE INVENTION

1. Field of the Invention

The present invention relates to an image forming apparatus such as an electrophotographic printer, for example, and an image forming method.

2. Description of the Related Art

In an image forming apparatus, such as an electrophotographic printer, which forms an image on a sheet, sheets are separated one by one from a cassette containing a plurality of sheets and is conveyed to an image forming section (e.g., a photosensitive drum). An image formed by the image forming section is transferred onto each sheet via a transfer roller. Then, the sheet is fed to a fixing section (e.g., a fixing roller) and is subjected to pressurization and heat treatment. After the transferred image is fixed on the sheet, the sheet is discharged outside the image forming apparatus.

Here, to transfer an image onto a sheet at a proper position, it is necessary to convey the sheet straight in a conveying direction without causing skewing of the sheet to the image forming section.

Conventionally, there has been a mechanism which stacks a plurality of sheets contained in a cassette in parallel to the conveying direction with a size regulating plate or the like provided in the cassette. However, mechanical means such as a size regulating plate cannot sufficiently correct skewing of a sheet.

There has also been a mechanism which corrects skewing of a sheet by causing a sheet fed from a cassette to be abutted against a registration roller disposed just before an image forming section.

Although this mechanism can sufficiently correct the skewing of a sheet with the registration roller, since conveyance of each sheet is temporarily stopped at the position of the registration roller, the time required for image formation becomes longer. The mechanism is thus unsuitable for an electrophotographic printer, such as an on-demand printer, which requires high productivity.

Additionally, it is impossible to perform registration in a lateral direction which is orthogonal to a sheet conveying direction (transverse registration) only by causing a sheet to be abutted against the registration roller.

To cope with this, there has been proposed a technique for correcting skewing of a sheet without stopping conveyance of the sheet by providing, a skewing mechanism which causes a sheet to be abutted against a stopper member parallel to the conveying direction while conveying the sheet obliquely to the conveying direction at a position just before the image forming section (see, e.g., Japanese Laid-Open Patent Publication (Kokai) No. 8-188300).

In this proposed technique, since the stopper member causes a sheet to be always conveyed at the same position in the lateral direction, good transverse registration can be achieved.

A sheet is conveyed while one side edge of the sheet along the conveying direction is in contact with the stopper member of the skewing mechanism. For this reason, a shifting mechanism which moves a sheet in the sheet lateral direction with a roller has been proposed to allow transfer of an image at a desired position. There has also been proposed a mechanism which changes the position of a stopper member in accordance with sheet size.

The shifting mechanism or the like allows an image to be always transferred onto a sheet at, e.g., a center position in the lateral direction in an image forming section. It is thus possible to centralize worn parts of a sheet conveying roller in an image forming apparatus and reduce skewing of a sheet. Since a sheet can always be fed to any post-processing device such as a stapler or a folding machine at a center position thereof, centering accuracy can be improved.

However, with an improvement in centering accuracy, there occurs a situation where microscopic asperities (rough projections) on two side edges of each of sheets of the same size in the lateral direction damage a fixing roller when the sheets are continuously conveyed. When a sheet larger in the lateral direction than the sheets having damaged the fixing roller passes through the fixing roller, the damage in the fixing roller causes a density difference in a toner image on the larger sheet.

In such a case, damage in a fixing roller is caused by sheets with the same width continuously passing through the fixing roller at the same position. To solve this problem, there has been proposed a technique for changing a sheet conveying position in the axial direction of a roller for every predetermined number of sheets (see, e.g., Japanese Laid-Open Patent Publication (Kokai) No. 10-293512).

To reduce damage in a fixing roller, a position at which a sheet is conveyed needs to be shifted upstream of the fixing roller in the sheet conveying direction. The method of shifting a sheet between a position at which a toner image is to be transferred onto a sheet and a fixing roller is available for this case. However, the arrangement of a sheet shifting mechanism between a transfer position and the fixing roller requires an increase in apparatus size and leads to a cost increase.

There is also available a method in which a sheet is shifted at the position just before the image forming section, as in the technique disclosed in Japanese Laid-Open Patent Publication (Kokai) No. 8-188300 described above. To shift a conveying position for every sheet and achieve good transverse registration, the positional accuracy of a sheet shifting mechanism needs to be improved.

Although a first possible method for improving the positional accuracy of a sheet shifting mechanism is to reduce the tolerance of the mechanism to as close to zero as possible, the method leads to a cost increase. Another possible method is to reduce the drive step size of the sheet shifting mechanism. However, shifting of a conveying position in micro-steps for every sheet slows the operation of the sheet shifting mechanism and significantly reduces productivity.

SUMMARY OF THE INVENTION

The present invention provides an image forming apparatus capable of reducing damage in a fixing section and printing a high-quality image on a sheet at low cost without reducing productivity and an image forming method.

In a first aspect of the present invention, there is provided an image forming apparatus comprising an image forming unit adapted to transfer an image formed on an image carrier onto a sheet, a fixing unit adapted to fix a transferred image on the sheet, a sheet shifting unit located upstream of the image forming unit in a sheet conveying direction and adapted to shift the sheet in a lateral direction which is orthogonal to the sheet conveying direction in the image forming apparatus, a shift controlling unit adapted to control the sheet shifting unit to control shifting of the sheet in the lateral direction, in order to change a position at which the sheet passes through the fixing unit, a storing unit adapted to store, for each of sheet shift positions, a correction amount for a tolerance of the position of the sheet shifted by the sheet shifting unit, and an image position controlling unit adapted to shift a position of the image formed on the image carrier in the lateral direction on the image carrier on the basis of the sheet shift position and the correction amount stored in the storing unit.

In a second aspect of the present invention, there is provided an image forming method of an image forming apparatus including an image forming unit that transfers an image formed on an image carrier onto a sheet, a fixing unit that fixes a transferred image on the sheet, and a sheet shifting unit that is located upstream of the image forming unit in a sheet conveying direction and shifts the sheet in a lateral direction which is orthogonal to the sheet conveying direction in the image forming apparatus, the image forming method comprising a first determining step of determining a sheet shift position in order to change a position at which the sheet passes through the fixing unit, a first controlling step of controlling the sheet shifting unit such that a sheet is shifted to the shift position determined in the first determining step, a second determining step of determining a correction amount for a tolerance of the position of the sheet shifted by the sheet shifting unit for the shift position determined in the first determining step, and an image position controlling step of shifting a position of the image formed on the image carrier in the lateral direction on the image carrier on the basis of the sheet shift position and the correction amount determined in the second determining step.

According to the present invention, the tolerance of the position of sheet shifted caused by insufficient mechanical accuracy of a sheet shifting mechanism when moving a sheet in a lateral direction orthogonal to a conveying direction by a predetermined amount with the sheet shifting mechanism can be corrected by shifting the position of an image formed on an image forming section. This makes it possible to reduce damage in a fixing section and print a high-quality image on a sheet at low cost without reducing the number of sheets having images formed thereon per unit time.

Further features and advantages of the present invention will become apparent from the following detailed description of exemplary embodiments with reference to the attached drawings.

DETAILED DESCRIPTION OF THE PREFERRED EMBODIMENTS

An embodiment of the present invention will be described in detail with reference to drawings showing preferred embodiments thereof.

Figure 1:
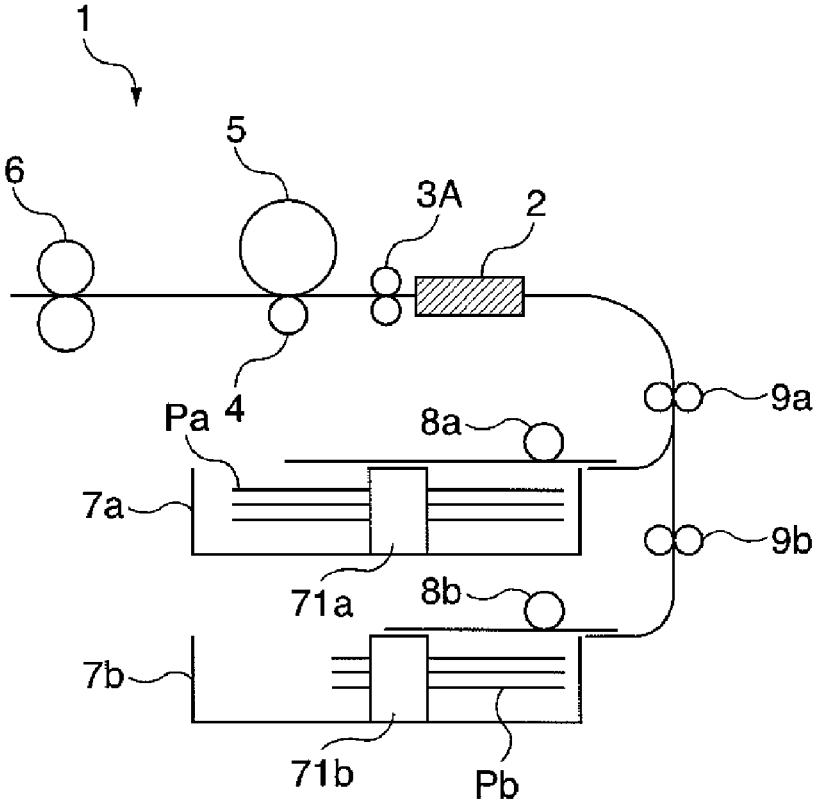
FIG. 1 is a sectional view schematically showing an example of the configuration of an image forming apparatus according to an embodiment of the present invention.
Figure 2:
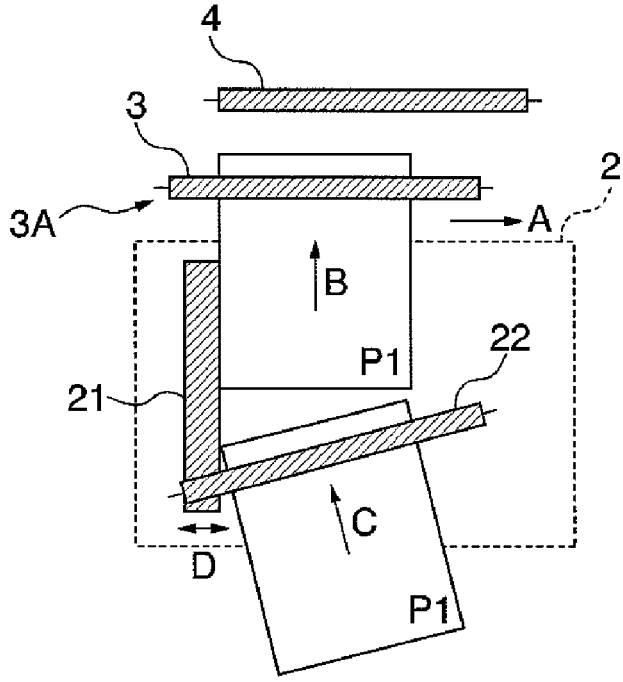
FIG. 2 is a schematic diagram for explaining a skewing mechanism, shifting rollers, and a transfer roller of the image forming apparatus shown in FIG. 1.
Figure 3:
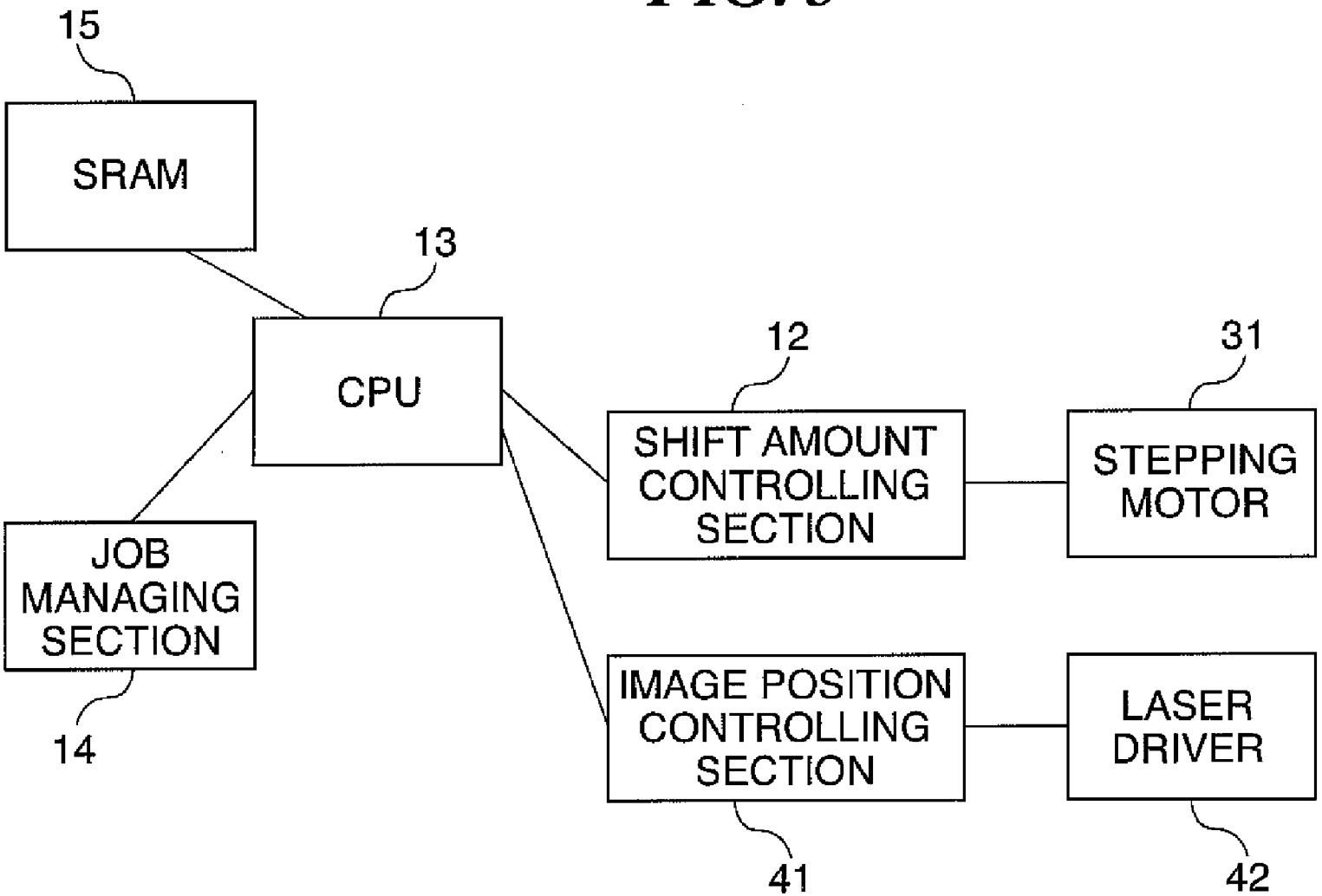
FIG. 3 is a block diagram for explaining a control system of the image forming apparatus shown in FIG. 1.

FIG. 1 is a sectional view schematically showing an example of the configuration of an image forming apparatus according to the embodiment of the present invention. FIG. 2 is a schematic diagram for explaining a skewing mechanism, shifting rollers, and a transfer roller of the image forming apparatus shown in FIG. 1. FIG. 3 is a block diagram for explaining a control system of the image forming apparatus shown in FIG. 1.

As shown in FIG. 1, an image forming apparatus 1 according to the embodiment of the present invention includes a skewing mechanism 2, a sheet shifting mechanism 3A, a transfer roller 4, a photosensitive drum 5 as an image carrier, fixing rollers 6, cassettes 7*a* and 7*b*, separating rollers 8*a* and 8*b*, and conveying rollers 9*a* and 9*b*.

Sheets Pa and sheets Pb different in size are contained in the cassettes 7*a* and 7*b*, respectively. The sheets Pa or Pb are regulated by a size regulating plate 71*a* or 71*b* such that they are stacked in parallel to a conveying direction.

When a printer job is submitted to the image forming apparatus 1 from an operating section (not shown), a host computer connected over a network, or the like, a sheet starts to be fed from one of the cassettes containing sheets of a designated size.

The separating roller 8*a* or 8*b* separates the plurality of sheets contained in the cassette one by one and guides each sheet deep into the image forming apparatus 1. Skewing of the sheet guided to the skewing mechanism 2 by the conveying roller(s) 9*a* and/or 9*b* is corrected, and the sheet is conveyed to the sheet shifting mechanism 3A. The sheet shifting mechanism 3A is disposed upstream of a position where an image is to be transferred onto the sheet in a sheet conveying direction. In order to align the sheet with a main scanning position in an image on the photosensitive drum 5, the sheet shifting mechanism 3A conveys the sheet toward the transfer roller 4 while moving the sheet in a main scanning direction.

Around the photosensitive drum 5 are components (not shown) for an electrophotographic process. Examples of the components around the photosensitive drum 5 include a charger for uniformly charging the surface of the photosensitive drum 5, an exposing section which forms an electrostatic latent image on the charged photosensitive drum 5 with laser beams or the like, and a developing section which makes the exposed electrostatic latent image on the photosensitive drum 5 visible with a developer such as toner. The leading edge of the image formed on the photosensitive drum 5 reaches the position of the transfer roller 4 at a time when a sheet reaches the transfer roller 4, and the image is transferred onto the sheet.

A sheet bearing a transferred toner image is conveyed to the fixing rollers 6 heated to about 200° C. The toner image formed on the sheet is fused by the nip pressure and heat of the fixing rollers 6 and is fixed on the sheet. The sheet bearing the fixed image is discharged outside the apparatus.

Note that although a toner image formed on the photosensitive drum is directly transferred onto a sheet in the above-described configuration, the present invention may be configured to use a known intermediate transfer member.

The skewing mechanism 2, sheet shifting mechanism 3A, and transfer roller 4 will be described with reference to FIG. 2.

As shown in FIG. 2, a sheet P1 guided to the skewing mechanism 2 is obliquely conveyed by skewing rollers 22 toward a stopper member 21 in a direction indicated by an arrow C. Since the nip pressure of the skewing rollers 22 is low, skewing of the sheet P1 is corrected while the sheet pivots along the stopper member 21. Note that the stopper member 21 is arranged to be movable, by a stepping motor (not shown), in a direction indicated by an arrow D.

When the sheet whose skewing of a sheet has been corrected by the skewing mechanism 2 reaches shifting rollers 3 of the sheet shifting mechanism 3A, the two paired skewing rollers 22 separate from each other. The shifting rollers 3 are arranged to be capable of reciprocating (shifting) in a sheet width direction (direction indicated by an arrow A) orthogonal to the sheet conveying direction by a stepping motor 31 (see FIG. 7). The shifting rollers 3 convey the sheet P1 in a direction indicated by an arrow B while moving it in the direction A. The paired shifting rollers 3 separate from each other at a time when the sheet P1 reaches the transfer roller 4 and move back in a direction opposite to the direction indicated by the arrow A. The paired shifting rollers 3 change from being separated from each other to being in contact with each other at a time when the trailing edge of the sheet P1 moves past the shifting rollers 3 to wait for the arrival of a next sheet.

A control system of the image forming apparatus 1 will be described with reference to FIG. 3.

As shown in FIG. 3, a CPU 13 interprets a program stored in a ROM (not shown) and performs predetermined control while reading/writing data from/to a RAM (not shown), an SRAM 15, and other peripheral circuits. Upon receipt of a job from the operating section (not shown), a host computer connected over a network, or the like, the CPU 13 accumulates job data in a job managing section 14 and performs page-by-page image forming operation.

The CPU 13 sets a shift amount for the shifting rollers 3 (hereinafter referred to as a roller shift amount) in a shift amount controlling section 12. The shift amount controlling section 12 drives the stepping motor 31 shifting the shifting rollers 3 in accordance with the set roller shift amount. SRAM 15 stores a roller shift amount and an image forming position correction amount indicative of the amount by which an image writing start position is to be adjusted in a table for each of shift positions R1, R2, and R3 shown in FIG. 10 (to be described in detail later). The CPU 13 causes an image position controlling section 41 to change an image writing start position for the photosensitive drum 5 on the basis of the table shown in FIG. 10 and causes a laser driver 42 to operate such that an image starts to be formed at the set image writing start position.

Figures 4A, 4B, 4C:
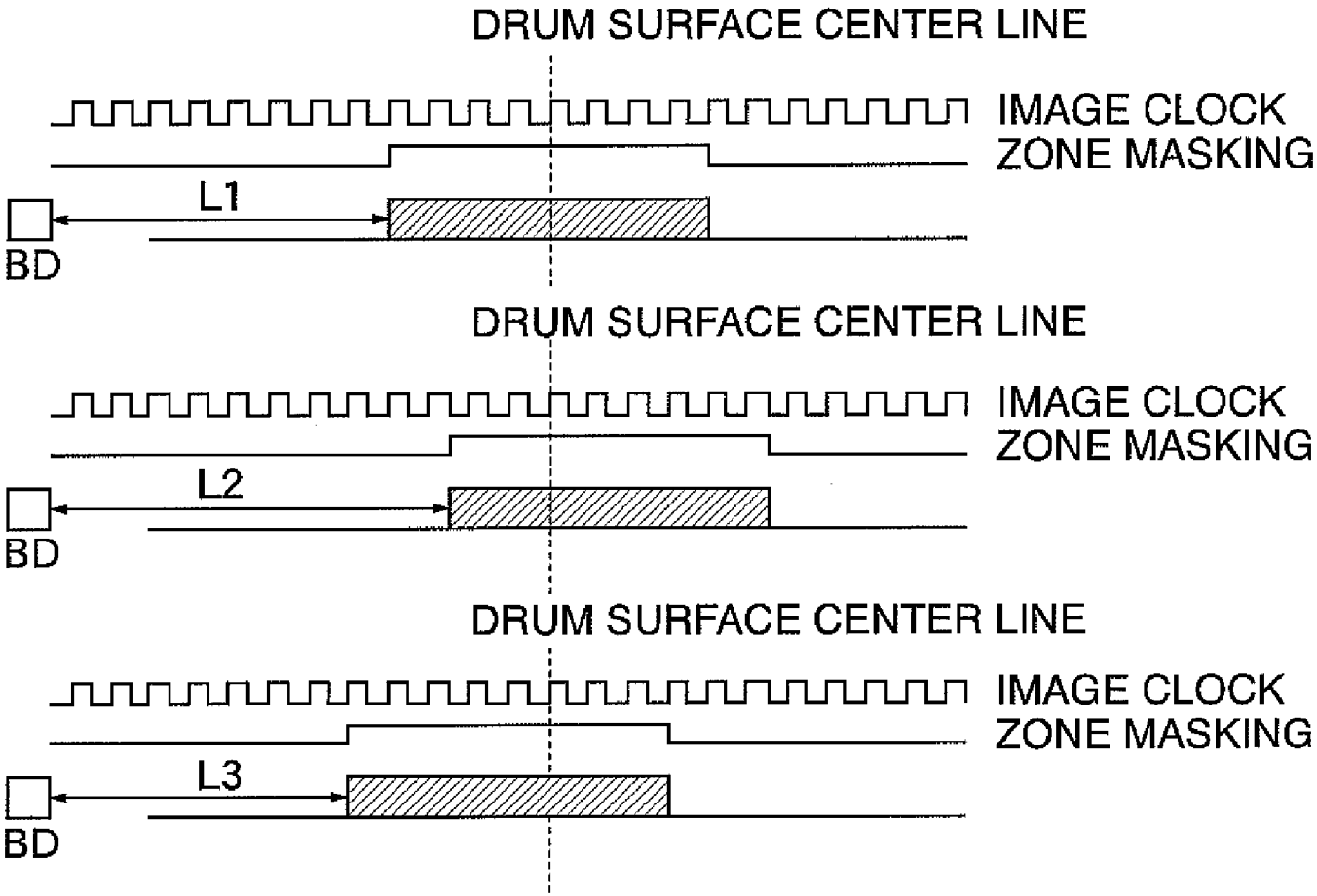
FIG. 4A is a chart for explaining an image writing start position in normal times determined by an image position controlling section and a laser driver 42 in FIG. 3, and FIGS. 4B and 4C are charts for explaining the image writing start position changed by the image position controlling section and laser driver in FIG. 3.

FIG. 4A is a chart for explaining an image writing start position in normal times determined by the image position controlling section 41 and laser driver 42 in FIG. 3, and FIGS. 4B and 4C are charts for explaining the image writing start position changed by the image position controlling section 41 and laser driver 42 in FIG. 3.

As shown in FIG. 4A, the CPU 13 normally controls the image position controlling section 41 and laser driver 42 such that the center of an image in the sheet width direction falls on a drum surface center line of the photosensitive drum 5. A laser scanning reference position is sensed by a BD (beam detector). When a pulse count for an image clock corresponding to a distance L1 is reached, zone masking starts being disabled. A position at which zone masking starts being disabled is behind the drum center line by half of the length in the sheet width direction of the image. A position at which zone masking stops being disabled is ahead of the drum center line by half of the length in the sheet width direction of the image. In the region where zone masking is disabled, data of the image is converted into a latent image on the photosensitive drum 5 by laser in sync with the image clock.

If the image is shifted in the direction A in FIG. 2, an image writing start position is changed to a position when the pulse count for the image clock corresponding to a distance L2 is reached, as shown in FIG. 4B. On the other hand, if the image is shifted in a direction opposite to the direction A in FIG. 2, the image writing start position is changed to a position when the pulse count for the image clock corresponding to a distance L3 is reached, as shown in FIG. 4C.

Figure 5:
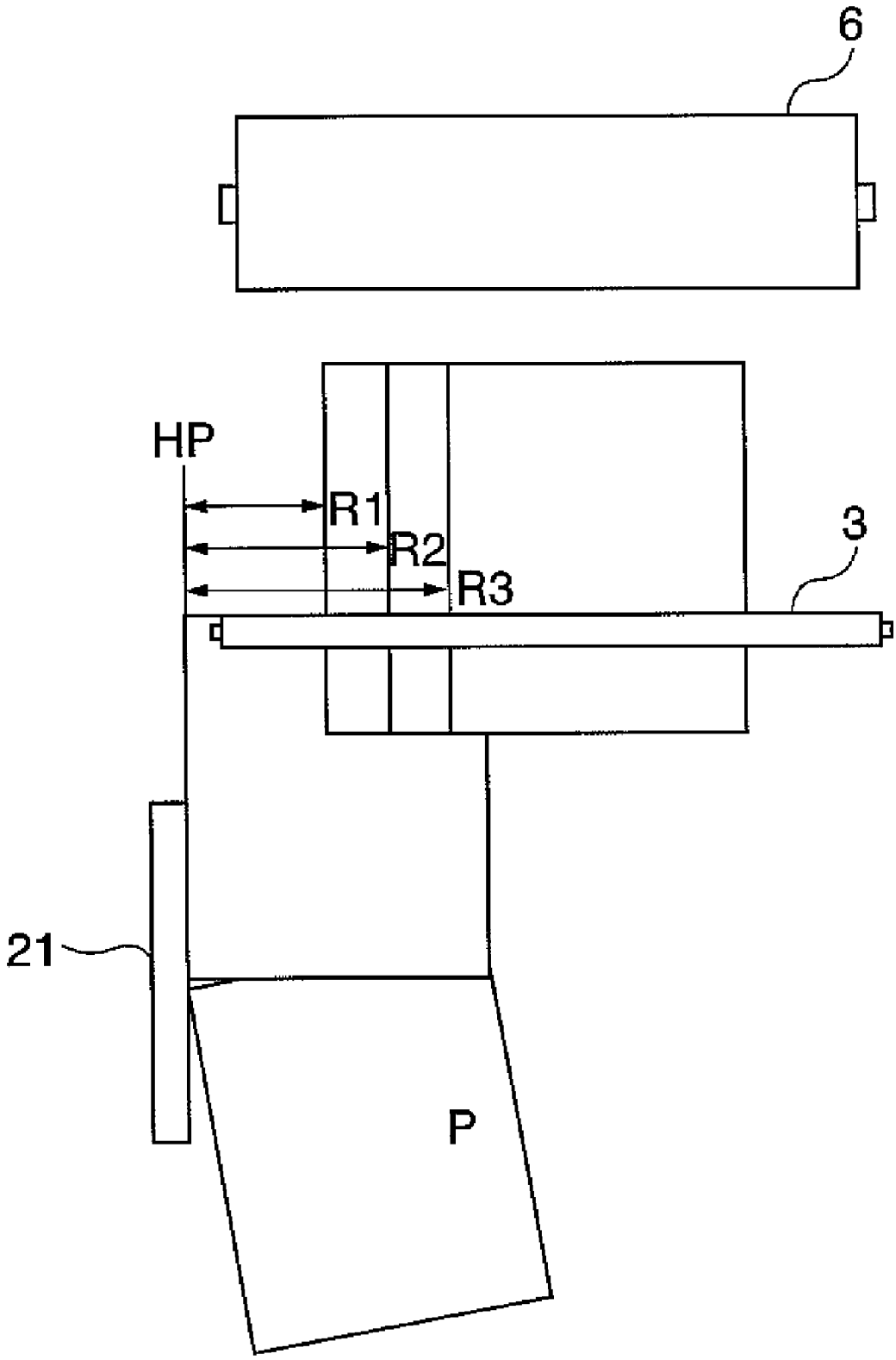
FIG. 5 is a view for explaining shifting operation of a sheet in a main scanning direction by a sheet shifting mechanism in FIG. 1.

FIG. 5 is a view for explaining shifting operation in the sheet width direction by the sheet shifting mechanism in FIG. 1.

As shown in FIG. 5, a sheet P is abutted against the stopper member 21, and its skewing is corrected. After that, the sheet P is conveyed while being moved in the sheet width direction by the shifting rollers 3 and then reaches a transfer position. Shift positions set for the shifting rollers 3 include three positions, R1 to R3. The shifting rollers 3 move from one of the shift positions R1 to R3 to a home position (HP) of the stopper member 21 and back to one of the shift positions R1 to R3, for every conveyance of a predetermined number of sheets.

Figure 7:
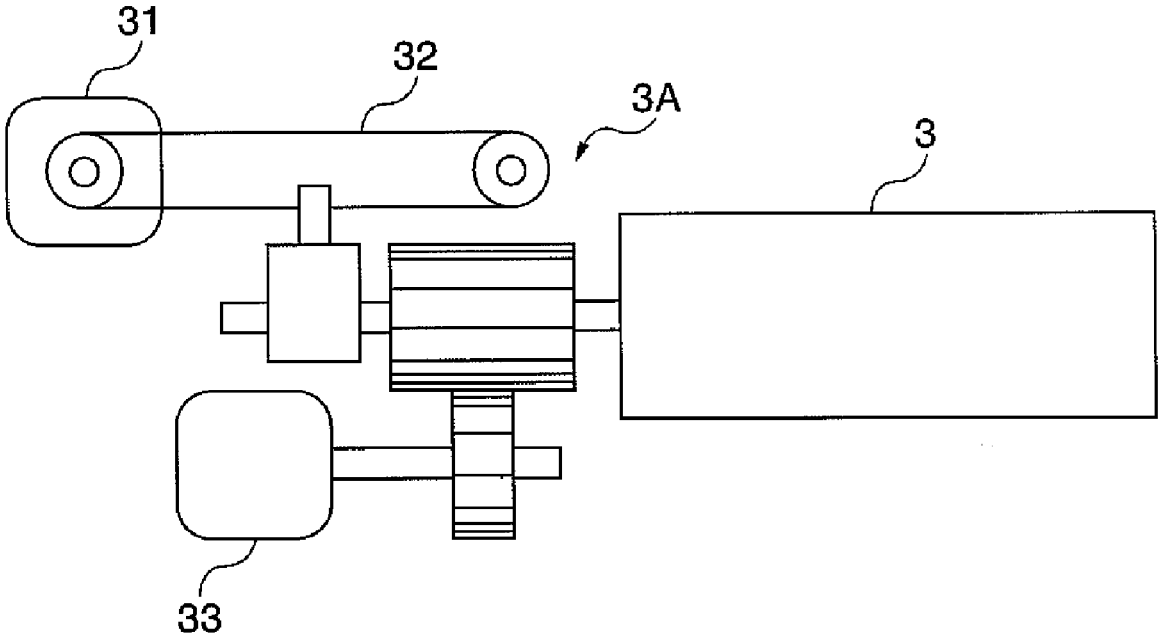
FIG. 7 is a view for explaining the sheet shifting mechanism in FIG. 1.

FIG. 7 is a view for explaining the sheet shifting mechanism 3A in FIG. 1. Each shifting roller 3 is driven by a shift roller motor 33 via a gear train to perform the rotating operation of conveying a sheet in the conveying direction. The shifting roller 3 is also driven by the shifting motor 31 via a belt pulley 32 to perform shifting operation in the sheet width direction. The roller shift amount of the shifting rollers 3 are controlled using the number of driving pulses of the shifting motor 31 which is a stepping motor. However, the diameter of the pulley has a tolerance and thus causes a tolerance in regard to the roller shift amount.

Figure 6:
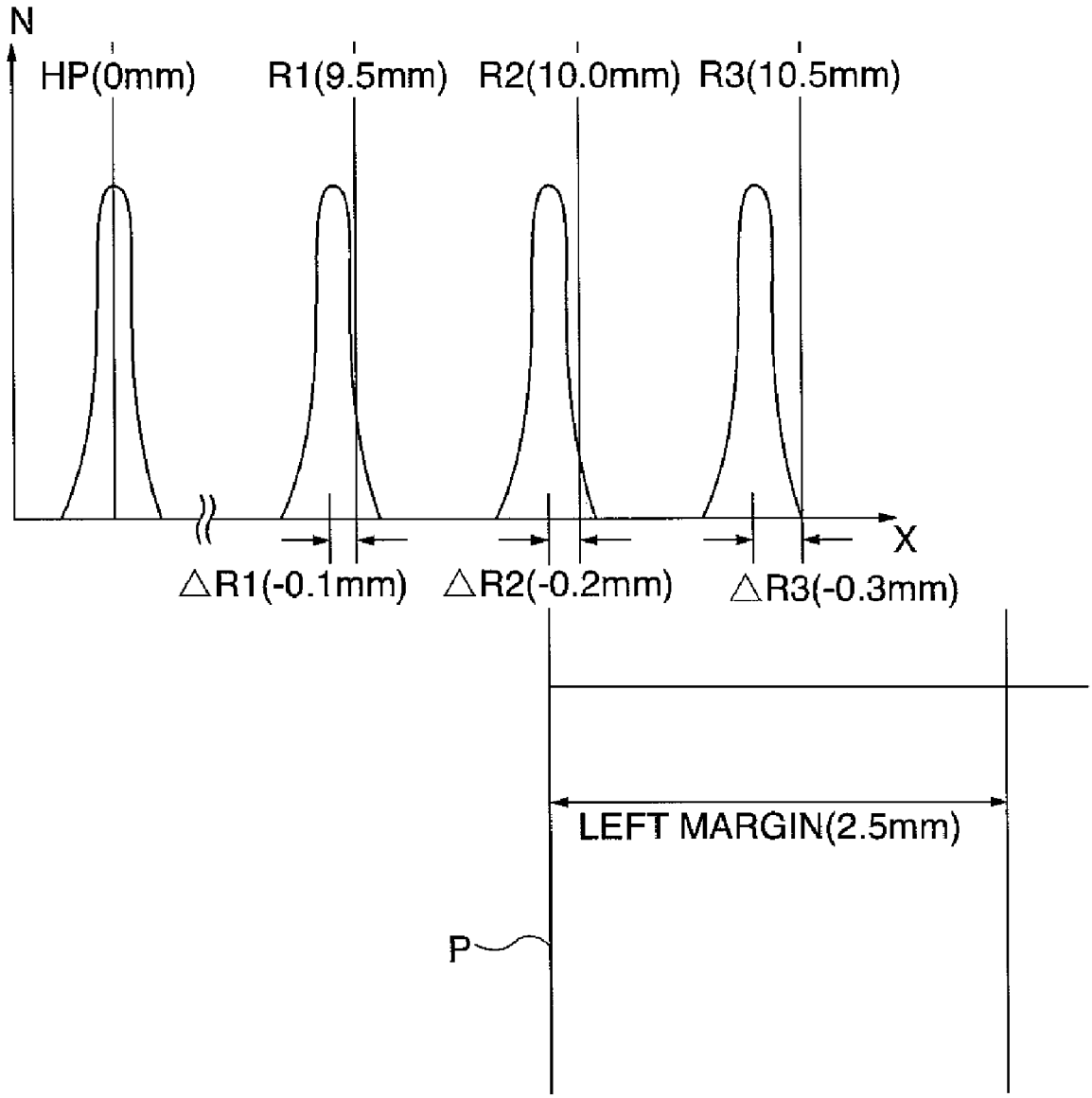
FIG. 6 is a view for explaining a tolerance in regard to sheet shifting amount caused by the sheet shifting mechanism in FIG. 1.

FIG. 6 is a view for explaining a tolerance in regard to sheet shifting amount caused by insufficient mechanical movement accuracy of the sheet shifting mechanism 3A in FIG. 1. The abscissa in FIG. 6 represents the movement distance of the shifting rollers 3 in the lateral direction while the ordinate represents the number N of stops with respect to distance.

The shifting rollers 3 move from the home position (HP=0 mm) to one of the shift positions R1 to R3 and back to the home position for every conveyance of the sheet(s) P. For example, the shift position is shifted to any of the shift positions R1 to R3 for every conveyance of one sheet P. A normal distribution as in FIG. 6 is obtained as stop position accuracy. Due to the tolerance of the pulley diameter or the like, the tolerances of the shift amount of the roller denoted by reference characters ΔR1 to ΔR3 are present with respect to the target shift positions R1 to R3, respectively. In the present embodiment, the value of ΔR1 is −0.1 mm, the value of ΔR2 is −0.2 mm, and the value of ΔR3 is −0.3 mm, for example. Since the tolerances of shift amount of the roller are accumulated, the magnitude of a total movement error varies according to a target shift position.

For example, it is assumed that the sheet P is shifted to the shift position R2. Even if the left margin of the sheet P is set to 2.5 mm in consideration of the tolerance ΔR2, when the sheet P is shifted to the shift position R1, the position of an image in the sheet width direction deviates by ΔR1-ΔR2. On the other hand, when the sheet P is shifted to the shift position R3, the position of the image in the sheet width direction deviates by ΔR2-ΔR3. The SRAM 15 stores the tolerances ΔR1 to ΔR3 as correction amounts. This makes it possible to cause a correction amount for a stop position of the shifting rollers 3 to vary according to the shift position for the sheet P.

Figure 8:
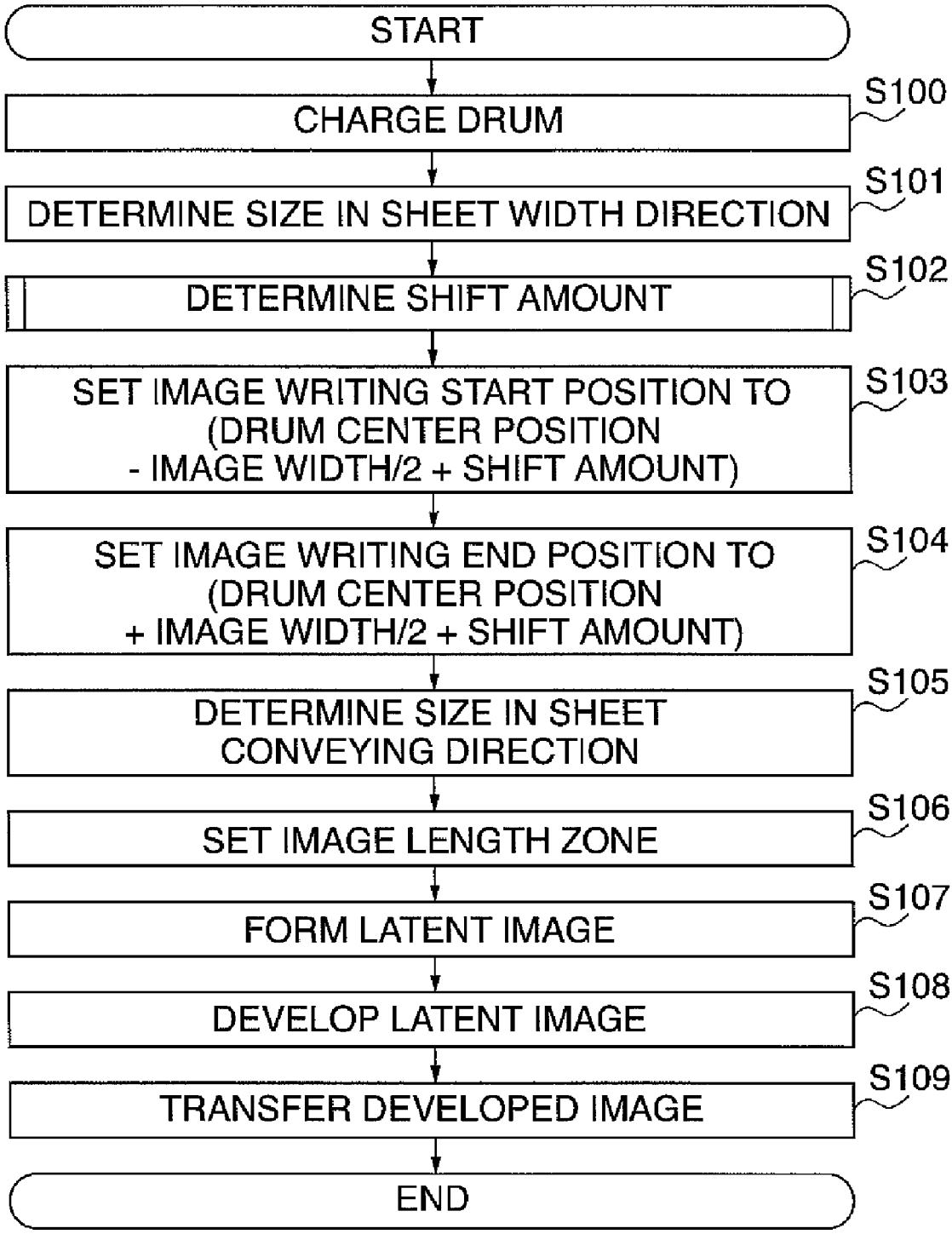
FIG. 8 is a flowchart for explaining an example of image forming operation in a photosensitive drum of FIG. 1.

An example of the operation of forming an image on the photosensitive drum 5 in FIG. 1 will be described with reference to FIG. 8. Note that, as for processes in FIG. 8, a program stored in the ROM or the like is loaded into the RAM and is executed by the CPU 13 via the image position controlling section 41 and laser driver 42.

First, the CPU 13 causes the charger to charge the photosensitive drum 5 (step S100) and determines the size in the sheet width direction of an image to be formed on the photosensitive drum 5 (step S101). Note that the size may be figured out using parameters accompanying image data. The CPU 13 determines a shift amount for an image forming position (an image forming position correction amount to be described later) by the process shown in FIG. 11 (step S102). The CPU 13 determines an image writing start position in the sheet width direction by calculating the expression (drum center position−image width/2+shift amount) and sets the image writing start position in the image position controlling section 41 (step S103). The CPU 13 also determines an image writing end position by calculating the expression (drum center position+image width/2+shift amount) and sets the image writing end position in the image position controlling section 41 (step S104).

The CPU 13 determines the size in the sheet conveying direction of the image to be formed on the photosensitive drum 5 (step S105) The CPU 13 sets an image length zone in the sheet conveying direction in the image position controlling section 41 (step S106). The CPU 13 controls the image position controlling section 41 and laser driver 42 to form a latent image on the photosensitive drum 5 such that image formation is performed in accordance with the set image writing start position, image writing end position, and the image length zone (step S107). The CPU 13 develops the latent image formed on the photosensitive drum 5 with a developer such as toner (step S108) and transfers the developed image onto a sheet (step S109), followed by terminating the program.

An example of the operation of the sheet shifting mechanism 3A in FIG. 1 will be described with reference to FIG. 9. Note that, as for processes in FIG. 9, a program stored in the ROM or the like is loaded into the RAM and is executed by the CPU 13 via the shift amount controlling section 12 and stepping motor 31.

First, the CPU 13 sets roller shift amounts (step S200). The CPU 13 reads out pieces of data for the shift positions R1 to R3 from the SRAM 15 (step S201) and converts each piece of data into the number of driving pulses of the stepping motor 31 (step S202). The CPU 13 sets one of the numbers of driving pulses obtained after the conversion in the shift amount controlling section 12 and drives the stepping motor 31 in accordance with the number of driving pulses set in the shift amount controlling section 12 (step S203).

The above-described process is performed by selecting any of the shift positions R1 to R3 for each of sheets to be conveyed.

Note that the image forming apparatus may be configured such that the shift amount controlling section 12 determines the number of driving pulses after the CPU 13 sets roller shift amounts in the shift amount controlling section 12.

Figures 9, 10:
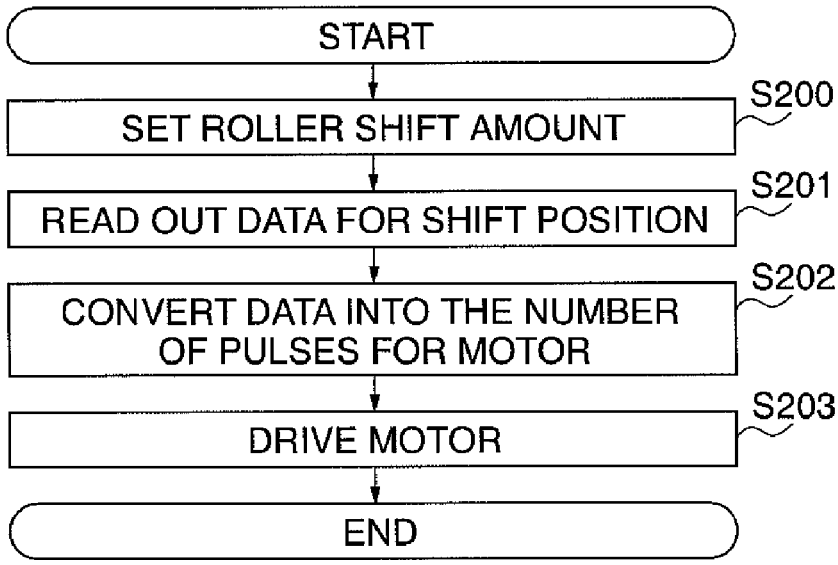
FIG. 9 is a flowchart for explaining an example of the operation of the sheet shifting mechanism in FIG. 1.
FIG. 10 is a chart showing a table of correspondence between roller shift amounts and fine image adjustment amounts corresponding to shift positions stored in an SRAM.

FIG. 10 is a chart showing a table of correspondence between roller shift amounts and image forming position correction amounts corresponding to the shift positions R1 to R3 stored in the SRAM 15. As for an image forming position correction amount in this table, the tolerances of the shift amount in the sheet shifting mechanism 3A is measured in advance before factory shipment and is stored as a shift correction amount in the SRAM 15. However, an image forming position correction amount may be input from an operation panel (not shown) after factory shipment.

Figure 11:
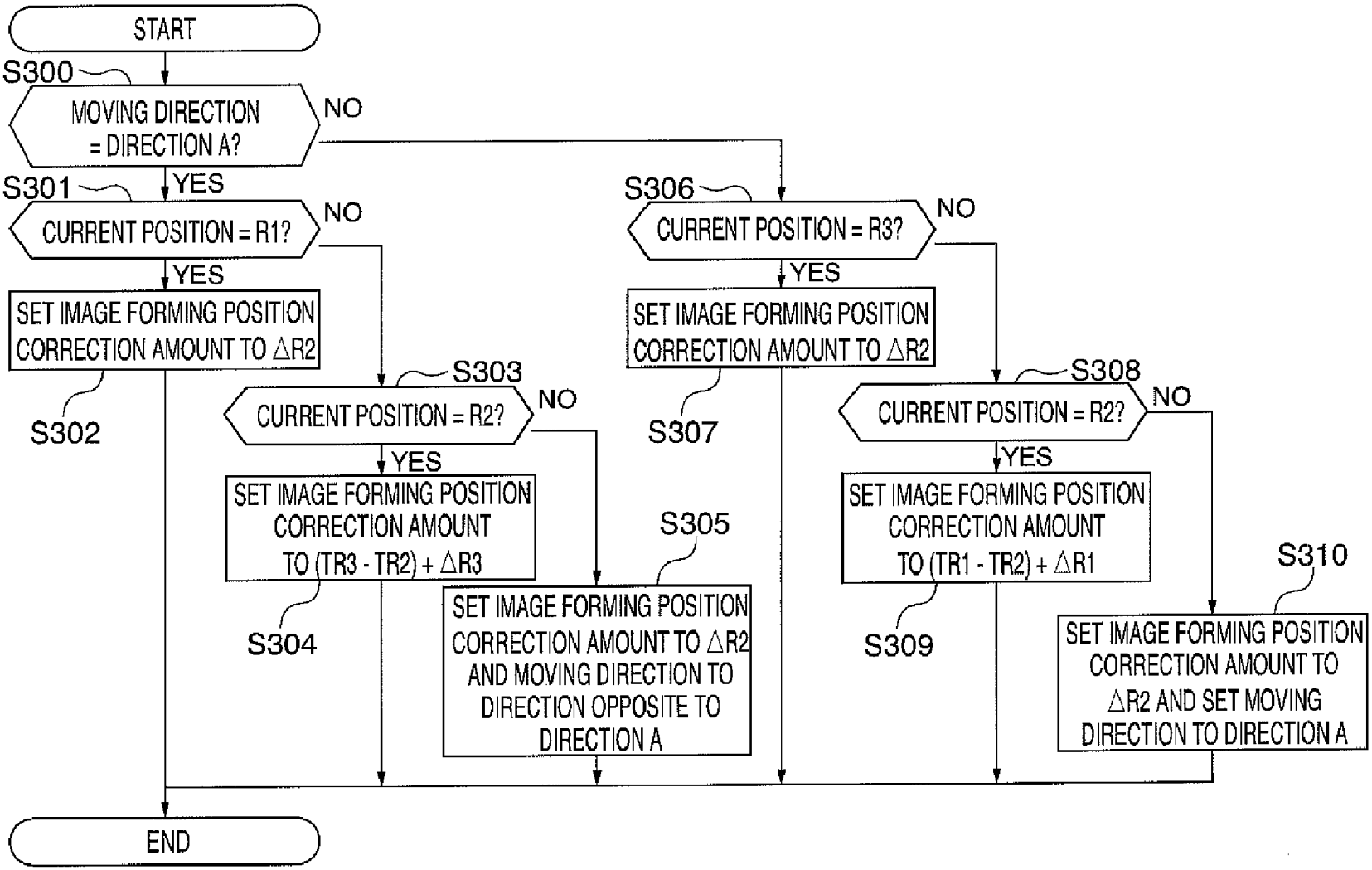
FIG. 11 is a flow chart for explaining a shift amount determining process in step S102 of FIG. 8.

The shift amount determining process in step S102 of FIG. 8 will be described with reference to FIG. 11. Note that in this embodiment, the shift position is changed in the sequence of R2, R3, R2, R1, R2, R3, . . . , for every conveyance of one sheet. The shift position may be changed for every conveyance of a predetermined number of sheets (e.g., two sheets). Reference characters TR1, TR2, and TR3 as shift amounts in FIG. 11 denote the distances from the home position HP to the positions R1, R2, and R3, respectively.

First, the CPU 13 determines whether the moving direction of the shifting rollers 3 is the direction A (the direction R1→R2→R3) in FIG. 2 (step S300). If the moving direction is the direction A, the CPU 13 determines whether the previous shift position (current position) is R1 (step S301). If the previous shift position (current position) is R1, the CPU 13 sets an image forming position correction amount to ΔR2 (step S302).

If it is determined in step S301 that the previous shift position (current position) is not R1, the CPU 13 determines whether the previous shift position is R2 (step S303). If the previous shift position is R2, the CPU 13 sets the image forming position correction amount to (TR3−TR2)+ΔR3 (step S304). If it is determined in step S303 that the previous shift position is not R2, the CPU 13 determines that the previous shift position is R3 and sets the image forming position correction amount to ΔR2. The CPU 13 also switches the moving direction of the shift position to the direction opposite to the direction A (the direction R3→R2→R1) (step S305).

If it is determined in step S300 that the moving direction is not the direction A in FIG. 2, the CPU 13 determines whether the previous shift position (current position) is R3 (step S306). If the previous shift position is R3, the CPU 13 sets the image forming position correction amount to ΔR2 (step S307). If it is determined in step S306 that the previous shift position is not R3, the CPU 13 determines whether the previous shift position (current position) is R2 (step S308). If the previous shift position is R2, the CPU 13 sets the image forming position correction amount to (TR1−TR2)+ΔR1 (step S309). If it is determined in step S308 that the previous shift position (current position) is not R2, the CPU 13 determines that the previous shift position is R1 and sets the image forming position correction amount to ΔR2. The CPU 13 also switches the moving direction to the direction A (the direction R1→R2→R3) (step S310), followed by terminating the program.

With this control, it is possible to correct an image forming position in consideration of the tolerance of the shift amount which varies according to a target shift position.

In the above description, an image writing start position and an image writing end position are obtained by calculation. However, a table indicating the relationship among image sizes, shift positions for the shifting rollers 3, image writing start positions, and image writing end positions may be stored in advance, and the table may be referred to for an image writing start position and an image writing end position.

Although the shift position is changed in the sequence of R1, R2, R3, R2, R1, R2, . . . in the above description, it may be changed in the sequence of R1, R2, R3, R3, R2, R1, R1, R2, . . . .

Note that the above-described lateral direction corresponds to a main scanning direction, which is generally used to describe an electrophotographic image forming apparatus and that the sheet conveying direction corresponds to a sub-scanning direction.

As described above, according to the present embodiment, the tolerance of the position of sheet shifted caused by insufficient mechanical accuracy due to the tolerance of the sheet shifting mechanism 3A is corrected by shifting the position in the lateral direction of an image to be formed on the photosensitive drum 5, when moving a sheet in the lateral direction. This makes it possible to reduce damage in the fixing roller 5 and form a high-quality image on a sheet at low cost without reducing the number of sheets having images formed thereon per unit time.

It is to be understood that the object of the present invention may also be accomplished by supplying a system or an apparatus with a storage medium in which a program code of software which realizes the functions of the above described embodiment is stored, and causing a computer (or CPU or MPU) of the system or apparatus to read out and execute the program code stored in the storage medium.

In this case, the program code itself read from the storage medium realizes the functions of the embodiment described above, and hence the program code and the storage medium in which the program code is stored constitute the present invention.

Examples of the storage medium for supplying the program code include a floppy disk, a hard disk, a magnetic-optical disk, a CD-ROM, a CD-R, a CD-RW, DVD-ROM, a DVD-RAM, a DVD-RW, a DVD+RW, a magnetic tape, a nonvolatile memory card, and a ROM. Alternatively, the program may be downloaded via a network.

Further, it is to be understood that the functions of the above described embodiment may be accomplished not only by executing a program code read out by a computer, but also by causing an OS (operating system) or the like which operates on the computer to perform a part or all of the actual operations based on instructions of the program code.

Further, it is to be understood that the functions of the above described embodiment may be accomplished by writing a program code read out from the storage medium into a memory provided on an expansion board inserted into a computer or in an expansion unit connected to the computer and then causing a CPU or the like provided in the expansion board or the expansion unit to perform a part or all of the actual operations based on instructions of the program code.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Application No. 2007-102925, filed Apr. 10, 2007, which is hereby incorporated by reference herein in its entirety.

What is claimed is:

1. An image forming apparatus comprising:

an image forming unit adapted to transfer an image formed on an image carrier onto a sheet;

a fixing unit adapted to fix a transferred image on the sheet;

a sheet shifting unit located upstream of said image forming unit in a sheet conveying direction and adapted to shift a position of the sheet in a lateral direction, orthogonal to a sheet conveying direction, to one of a plurality of target shift positions so as to change a position where an edge of the sheet passes through said fixing unit from that of another sheet on which a transferred image is to be fixed by said fixing unit;

a shift position determining unit adapted to determine the one of the target shift positions where the sheet is to be shifted by said sheet shifting unit; and an image position determining unit adapted to determine a position of the image to be formed on the image carrier in the lateral direction on the image carrier on the basis of the target shift position determined by said shift position determining unit and a tolerance preliminarily set with respect to each of the target shift positions.

2. An image forming method of an image forming apparatus including an image forming unit that transfers an image formed on an image carrier onto a sheet, a fixing unit that fixes a transferred image on the sheet, a sheet shifting unit that is located upstream of the image forming unit in a sheet conveying direction and shifts a position of the sheet in a lateral direction, orthogonal to a sheet conveying direction, to one of a plurality of target shift positions so as to change a position where an edge of the sheet passes through the fixing unit from that of another sheet on which a transferred image is to be fixed by the fixing unit, the image forming method comprising:

a shift position determining step of determining the one of the target shift positions where the sheet is to be shifted by the sheet shifting unit; and an image position determining step of determining a position of the image to be formed on the image carrier in the lateral direction on the image carrier on the basis of the shift position determined in said shift position determining step and a tolerance preliminarily set with respect to each of the target shift positions.

3. An image forming apparatus as claimed in claim 1, wherein the position of the image to be formed, determined by said image position determining unit, is a position to which an image forming position determined based on the one of the target shift positions is corrected in accordance with the tolerance.

4. An image forming apparatus as claimed in claim 1, further comprising a storing unit adapted to store a correction amount in accordance with the tolerance.

5. An image forming apparatus as claimed in claim 1, wherein said shift position determining unit is adapted to determine the one of the target shift positions in accordance with a number of sheets on which transferred images are to be fixed by said fixing unit.

* * * * *